US005261174A

United States Patent [19]

Blegen

[11] Patent Number: 5,261,174

[45] Date of Patent: Nov. 16, 1993

[54] COMBINED MAGNETIC PICTURE FRAME AND GIFT CARD

[76] Inventor: William E. Blegen, 20295 Manor Rd., Shorewood, Minn. 55331

[21] Appl. No.: 847,115

[22] Filed: Mar. 6, 1992

[51] Int. Cl.[5] ..... G09F 01/12; G09F 01/04

[52] U.S. Cl. ..... 40/152; 40/124.1; 40/594; 40/600

[58] Field of Search ..... 40/600, 152, 594, 154, 40/156, 159, 159.1, 124.1

[56] References Cited

U.S. PATENT DOCUMENTS

| | | | |
|---|---|---|---|
| 1,038,652 | 9/1912 | Reese | 40/152 |
| 2,176,535 | 10/1939 | Markoff | 40/159 |
| 4,200,222 | 4/1980 | Fever | 40/124.1 X |
| 4,439,941 | 4/1984 | Halperin | 40/124.1 |
| 4,785,562 | 11/1988 | Good | 40/159.1 |
| 4,912,864 | 4/1990 | Price | 40/600 X |
| 4,951,969 | 8/1990 | Epstein et al. | 40/124.1 X |
| 4,975,137 | 12/1990 | Cross . | |
| 4,987,692 | 1/1991 | Fast | 40/657 |
| 4,989,355 | 2/1991 | Thomas | 40/427 |
| 5,001,853 | 3/1991 | Odien | 40/312 |
| 5,002,181 | 3/1991 | Leppo . | |
| 5,004,271 | 4/1991 | Piatt . | |
| 5,009,624 | 4/1991 | Estam-Goggin . | |
| 5,010,669 | 4/1991 | Moran | 40/539 |
| 5,014,455 | 5/1991 | Desaderata | 40/539 |
| 5,022,681 | 6/1991 | Penick . | |

FOREIGN PATENT DOCUMENTS

| | | | |
|---|---|---|---|
| 1085593 | 10/1967 | United Kingdom | 40/124.1 |
| WO/8801419 | 2/1988 | World Int. Prop. O. | 40/124.1 |

OTHER PUBLICATIONS

Two-page ad entitled "Even Our Most Beautiful Frames Are Tacky", 3M Consumer Stationary Division, ©1991.

Ad from Parents Magazine, Nov. 1991, entitled "Even Our Most Beautiful Frames Are Tacky", 3M Consumer Stationary Division.

Display card for "Flashbacks" Instant Photo Framer, 3M Consumer Stationery Div. ©1990.

Sample of "Flashbacks" Instant Photo Framer, entitled "The Daily Journal", 3M Consumer Stationary Division.

*Primary Examiner*—Peter R. Brown
*Assistant Examiner*—J. Bonifanti
*Attorney, Agent, or Firm*—Merchant, Gould, Smith, Edell, Welter & Schmidt

[57] ABSTRACT

A picture frame made from a flexible magnetic sheet material is disclosed which is part of a mailer including a gift card and envelope. The gift card has a front surface carrying parallel strips of double-sided adhesive tape each having an outwardly facing releasable adhesive on one side to which the picture frame can be attached to display a photograph between the picture frame and card. The recipient of the mailer can peel the flexible picture frame from the card, remove the photograph, and magnetically attach the picture frame to a metal surface to display the photograph.

12 Claims, 1 Drawing Sheet

COMBINED MAGNETIC PICTURE FRAME AND GIFT CARD

BACKGROUND OF THE INVENTION

FIELD OF THE INVENTION

The present invention is directed to a gift card having a surface carrying strips of releasable adhesive to which a picture frame made from a flexible magnetic sheeting material can be secured to display a photograph there between, the flexible magnetic sheeting material being removable for magnetic attachment to a metal surface to display the photograph.

DESCRIPTION OF THE PRIOR ART

Various mailers have been developed which permit a photograph to be displayed as part of a greeting card or the like. Persons receiving such photographs often display them by tacking them to bulletin boards, by taping them or adhesively securing them to various surfaces, or by using magnets to secure them to metal doors or refrigerators. None of the prior art arrangements have provided a means of both mailing a photograph in a decorative magnetic picture frame and also using the same magnetic picture frame to display the photograph on a vertical metal wall surface.

SUMMARY OF THE INVENTION

According to the present invention, a picture frame is constructed from a flexible magnetic sheeting material which can be attached to metal surfaces such as a metal door or the outer surfaces of a refrigerator. The sheeting material can be constructed as a picture frame suitable for displaying a photograph, and the front surface thereof can be imprinted to provide a decorative appearance. A gift card is also provided as part of a mailer which includes the picture frame. The gift card is provided with strips of releasable adhesive material so that the picture frame can be releasably attached to the gift card with a photograph displayed between the picture frame and the gift card so that the unit can be inserted in a mailing envelope for mailing to a recipient. Upon receipt of the mailer, the recipient can remove the flexible picture frame from the gift card, along with the photograph, and use the flexible magnetic picture frame to hold the photograph on a refrigerator or the like for display purposes.

DESCRIPTION OF THE PREFERRED EMBODIMENT

Figure 1:
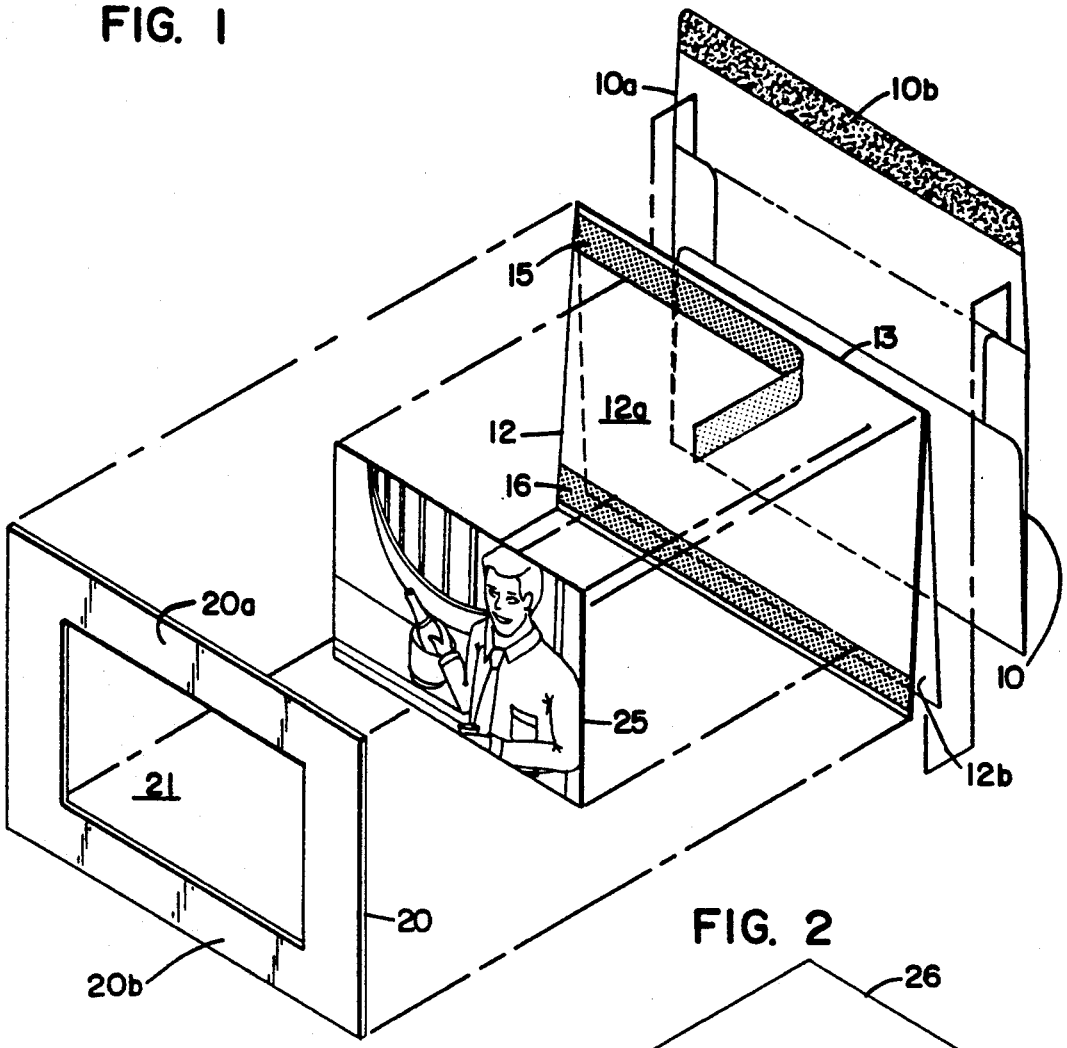
FIG. 1 is an exploded view in perspective of a combined magnetic, picture frame and gift card mailer according to present invention.

Referring to FIG. 1, there is disclosed a standard mailing envelope 10 approximately 5-inch by 7-inch in size having a flap 10*a* to close the envelope, flap 10*a* having an adhesive strip 10*b* for the purpose of sealing flap 10*a* against the envelope body.

A gift card 12 is provided which is made from folded card stock. Gift card 12 is a foldable sheet member having a first panel 12*a* and a second panel 12*b* of the same size and the panels are folded along a fold line 13 so that the resulting card 12 is sized to be inserted in envelope 10. Panel 12*a* has a front surface having mounted thereon two strips of double-sided adhesive tape 15 and 16. Tapes 15 and 16 comprise a carrier film having a high tack adhesive on one side for permanently securing the tape to the front surface of panel 12*a*, and a low tack "removable" adhesive on an opposite side. In the preferred embodiment, tape strip 15 is secured along fold line 13 which is one of the longer sides of the rectangular panel 12*a*. Although strip 15 is shown to be spaced from adjacent fold 13, it could be positioned directly adjacent thereto without departing from the invention. In FIG. 1, tape strip 15 is shown with a portion of the strip secured to panel 12*a* and a portion folded away so that the adhesive on the opposite side can be seen. However, it is understood that the entire length of strip 15 would be applied against panel 12*a* in the same fashion as strip 16. Strip 16 is secured to panel 12*a* along the edge of panel 12*a* which is opposite from fold 13. Again, it is shown spaced from the edge but it could be positioned directly adjacent thereto depending upon the sizes of the photograph and picture frame to be used.

3M Company markets at least two different types of double-sided tape which can be used for strips 15 and 16. The tapes have adhesives on both sides of a film which functions as a carrier for the adhesives. A permanent high tack adhesive is placed on one side and a removable low tack adhesive is placed on the other side of the film. The tapes come with a liner which can be removed and discarded. One type of tape which can be used is identified as 3M Scotch Brand No. 9415, which has a poly-coated liner. Another type of tape which can be used is 3M Scotch Brand No. 928, which has a tissue liner. The ¾ inch wide No. 928 tape is preferable because it is less expensive than the No. 9415 tape. The removable adhesive is similar to that used on Post-it Brand notes. In the preferred embodiment, a ¾ inch wide tape strip is used but again, other widths could be used depending upon the relationships involved.

Also shown in FIG. 1 is a picture frame 20 having a central opening 21, which is constructed from flexible magnetic sheeting material. In the preferred embodiment, picture frame 20 is rectangular and is the same size as panel 12*a*. Picture frame 20 has an upper frame member 20*a* and a lower frame member 20b and in the preferred embodiment members 20*a* and 20*b*, are each one inch in width. The side frame members are each, about 1⅛ inches in width.

Upper and lower frame members 20*a*, 20*b* are spaced to make contact with tape strips 15, 16 for releasably securing frame 20 to the front surface of panel 12*a*. When picture frame 20 is moved into contact with tape strips 15, 16 the outwardly disposed releasable adhesive contacts frame members 20*a*, 20*b* to securely hold picture frame 20 in place against card 12. A photograph 25 can be placed against the front surface of panel 12*a* between tape strips 15, 16 so as to show through picture frame opening 21 but at the same time be held in place by the rear surface of the picture frame. The rectangular opening 21 is preferably smaller in size than photograph 25 so that a portion of frame 20 surrounding opening 21 lies against the edges of picture 25 to hold it in place. In the embodiment shown, a 3½ inch by 5 inch photograph 25 is shown but a 4 inch by 6 inch photo could also be displayed. Photograph 25 would thus basically fit between strips 15, 16 to be held in place by the overlying picture frame 20. However, the strips 15, 16 could be moved closer together so that the interior edges of strips 15, 16 would engage the upper and lower edges of the photograph. In either case, parallel strips 15, 16 are spaced and sized to extend beyond opposite edges of the photograph being displayed to leave their upper and lower edges free to secure picture frame 20 to panel 12*a*.

Picture frame 20 can be constructed from a commercially available flexible magnetic sheeting material called KOROSEAL. KOROSEAL sheeting material is a thermoplastic permanent magnet material. The magnets embedded in the material are polarized so that the sheeting will be magnetically, attracted to metal surfaces. The face of the KOROSEAL sheeting material can also be imprinted with messages or decorative material by screen printing, hot stamping, thermography or hand lettering. The KOROSEAL sheeting can be easily cut and trimmed into the desired shape. The preferred thickness of the material for this application is 0.020 inch.

Figure 2:
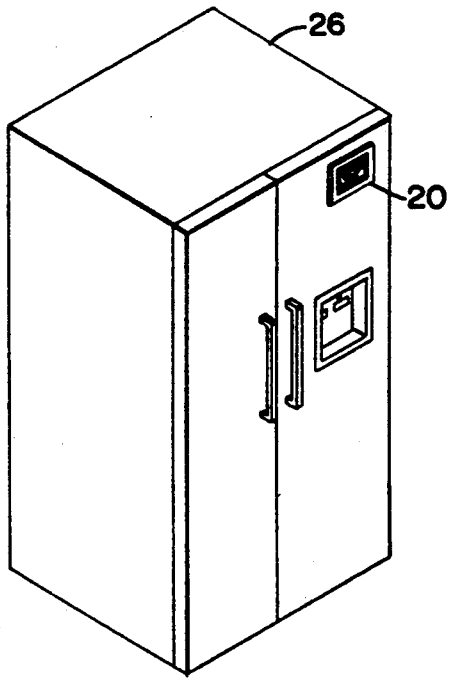
FIG. 2 is a view in perspective of the front, top and one side of a refrigerator having the magnetic picture frame magnetically attached thereto for display of a picture.

It is intended that the picture frame 20, card 12 and envelope be sold as a unit to customers who wish to mail a selected photograph to another party. Thus, the customer would purchase the combination, would remove picture frame 20 from card 12 by peeling it away from the releasable adhesive on strips 15 and 16. The photograph 25 would then be positioned against the front surface of panel 12*a* between or slightly overlapping strips 15 and 16, and then picture frame 20 would be once again positioned against panel 12*a* to be held in place by the releasable adhesive on strips 15 and 16. The unit would then be mailed to another party who would remove the combined picture frame, photograph and gift card from the envelope, peel away picture frame 20 and remove photograph 25, which could then be mounted on a refrigerator 26 as shown FIG. 2. Because picture frame 20 is constructed from the magnetic sheeting, it will naturally be attracted to the metal door or side wall of refrigerator 26 and will hold the photograph in place so that it can be viewed through opening 21. Picture frame 20 can thus be attached to any metal surface such as the side of an oven or to a metal door. After the picture frame and photograph are removed from card 12, the card and mailing envelope 10 can be discarded if desired. Because picture frame 20 is made from magnetic material, no tacks, adhesives or magnets are needed to apply it to the refrigerator door and when it is removed, it will leave no residue behind. Once the recipient has the picture frame, it can be used over and over again to display different photographs or other materials in the same fashion.

It will be apparent to those skilled in the art that a variety of modifications may be made to the product of the present invention without departing from the spirit and scope of the following appended claims.

What is claimed is:

1. A combined magnetic picture frame and gift card, comprising:

(a) a piece of card stock having a front surface;

(b) two strips of double-sided adhesive tape secured in spaced apart positions to said front surface, said tape comprising a carrier film having a high tack adhesive on one side for securing said tape to said front surface, and a low tack adhesive on an opposite side; and (c) a picture frame of approximately the same size as said front surface attached to said adhesive strips, said picture frame having a central opening smaller than a photograph to be displayed therethrough, constructed from a magnetic sheet material and having frame members spaced to make contact with said low tack adhesive on said strips of tape for releasively securing said frame to said front surface, a photograph positioned therebetween for display through said opening, said frame being removable from said adhesive tapes on said front surface for magnetic attachment to a vertical metal surface to display the photograph.

2. The combined magnetic picture frame and gift card of claim 1 wherein said strips are parallel to each other and spaced and sized to extend beyond opposite edges of a photograph being displayed while leaving outer edges free to secure said picture frame to said front surface.

3. The combined magnetic picture frame and gift card of claim 1 wherein said front surface has upper and lower edges, said strips being attached adjacent said edges, said upper and lower frame members being wider than said strips to both engage said strips and also hold a photograph in place between said frame and said front surface.

4. A combined picture frame and gift card, comprising:

(a) a card;

(b) a picture frame of generally the same size as said card, having an opening and comprising a magnetic sheet;

(c) low tack releasable adhesive means for attaching said frame to said card;

(d) said picture frame being secured to said card by means of said adhesive so that a picture can be positioned therebetween for display through said opening, said frame being removable from said card for magnetic attachment to a metal display surface.

5. The combined picture frame and gift card of claim 4 wherein said adhesive means comprise two strips of double-sided adhesive tape attached on said card parallel to each other and spaced and sized to extend beyond opposite edges of a photograph being displayed while leaving outer edges free to secure said picture frame to said card.

6. The combined picture frame and gift card of claim 5 wherein said picture frame has frame members, and an opening which is smaller than the size of a photograph to be displayed therethrough and wherein said frame members and opening are sized to display either of two standard sized photographs.

7. The combined picture frame and gift card of claim 5 wherein said card has a front surface with upper and lower edges, said strips being attached adjacent said edges, said picture frame being a flexible magnetic sheet approximately the same size as said front surface, said frame having upper and lower frame members which are wider than said strips to both engage said strips and also hold a photograph in place between said picture frame and said card.

8. A combined magnetic picture frame and gift card, comprising:

(a) a gift card having a front surface;

(b) a picture frame comprising a flexible magnetic sheet;

(c) adhesive means on said front surface releasibly attaching said frame to said card;

(d) said picture frame having an opening, and a picture positioned between said frame and said card for display through said opening, said frame and picture being removable from said card for magnetic attachment to a vertical metal display surface.

9. The combined magnetic picture frame and gift card of claim 8 wherein said picture frame has an opening which is smaller than the size of a picture to be displayed therethrough.

10. The combined magnetic picture frame and gift card of claim 9 wherein said picture frame is approximately the same size as said card, said frame being larger than said picture to both engage said card and also hold the picture in place between said frame and said card.

11. The combined magnetic picture frame and gift card of claim 10 wherein said frame is a sheet of flexible thermoplastic permanent magnet material.

12. The combined magnetic picture frame and gift card of claim 8 wherein said frame is a sheet of flexible permanent magnet material and wherein said card comprises a panel of generally the same size as said picture frame.

* * * * *